United States Patent [19]

Stone

[11] 4,382,526

[45] May 10, 1983

[54] DISPENSING CONTAINER AND BLANKS THEREFOR

[75] Inventor: Orison W. Stone, New Haven, Vt.

[73] Assignee: Pack Image Incorporated, Middlebury, Vt.

[21] Appl. No.: 32,741

[22] Filed: Apr. 24, 1979

[51] Int. Cl.[3] ..... A47F 3/024; B65D 5/72

[52] U.S. Cl. ..... 221/34; 206/44.12; 221/305; 229/17 B; 312/118

[58] Field of Search ..... 221/305, 309, 34, 92; 229/17 B, 29 C, 16 D; 206/44.11, 44.12; 312/118

[56] References Cited

U.S. PATENT DOCUMENTS

| | | | |
|---|---|---|---|
| 1,628,439 | 5/1927 | Staubly | 221/305 X |
| 1,898,056 | 2/1933 | Johnson | 221/309 X |
| 2,037,143 | 4/1936 | Nutt | 206/44.11 |
| 2,142,883 | 1/1939 | Chaney et al. | 206/44.12 |
| 2,595,202 | 4/1952 | Pardee | 229/17 B |
| 2,765,906 | 10/1956 | Rossum | 221/305 X |
| 2,785,843 | 3/1957 | Shaw | 206/44.12 X |
| 2,892,536 | 6/1959 | Newell | 229/17 B X |
| 3,450,308 | 6/1969 | Schoenfeld | 221/305 |

*Primary Examiner*—F. J. Bartuska

*Attorney, Agent, or Firm*—Wood, Herron & Evans

[57] ABSTRACT

The disclosed wall-mounted paperboard container for dispensing stacked articles, one at a time, has a mouth opening in a lower portion of a front wall. The mouth opening is formed from a container blank by infolding a lip panel and gusset flaps in front and side wall panels of the blank. The infolded lip panel supports the stack of articles so that the articles are inclined downwardly and rearwardly. Access to the articles is had by pulling the bottommost article in the stack outwardly through the mouth opening.

3 Claims, 8 Drawing Figures

DISPENSING CONTAINER AND BLANKS THEREFOR

BACKGROUND OF THE INVENTION

The present invention relates to containers formed from foldable sheet material, and more particularly, to a wall mounted, gravity-fed dispensing container.

Paperboard containers are used extensively in packaging a wide variety of products. It has been recognized that economies can be achieved by dispensing products directly from containers in which they are shipped. In this connection, the following patents are of general interest: U.S. Pat. Nos. 3,300,115 to Schauer; 2,036,864 to Einson; 1,959,231 to Dube; and 1,189,779 to Becker.

It is often useful to provide sequential access to the articles in the container so that they may be orderly removed, one at a time, as they are needed. To this end, a number of gravity-fed dispensing containers have been developed, in which a mouth is cut away from a lower portion of the container and a stack of articles is supported in the container so that the articles slope forward. A retaining lip engages the bottommost article in the stack. Such containers are shown in U.S. Pat. Nos. 1,341,893 and 1,956,642 to Fitzgerald and Einson, respectively.

These prior art containers have the disadvantage in that removal of the bottommost article from the stack requires raising of the article to clear the lower lip and inclining the article in an opposite way from the remaining articles of the stack while pulling the article outwardly. In addition the forward slope of the articles is achieved with some difficulty: Fitzgerald requires a second blank to form a sloping insert; Einson employs a rhombohedral container which may present problems if the containers are to be shipped in a larger, rectangular carton.

A somewhat different approach to the design of gravity-fed dispensing containers is illustrated in U.S. Pat. Nos. 1,764,468 and 1,898,056 to Pratt and Johnson, respectively. Pratt discloses a dispensing container in which the stack of articles (rather than the individual articles) and the container are inclined by an easel back support. Johnson discloses a dispensing carton for cylindrical articles in which a downwardly and rearwardly inclined lip is used to prevent unassisted discharge of the cylindrical articles. Neither container is adapted for wall mounting or dispensing from a vertical stack of articles or packets.

Accordingly, it is an object of the present invention to provide a vertically oriented, container for dispensing articles which may be wall mounted or calmit mounted.

It is another object of the present invention to provide a gravity-fed container for dispensing from a vertical stack of articles.

It is a further object of the present invention to provide an inexpensively and easily fabricated container for inclining and dispensing articles, one at a time from a vertical stack.

Frequently, the cost of packaging numerous small articles in a larger container is a significant portion of the delivered cost of the packaged product. This is particularly true in the case of containers for small, inexpensive notions, individually wrapped in flat packets, such as pads inpregnated with soap, spot remover, shoe polish, etc.

Accordingly, it is an object of the present invention to provide an inexpensively and easily fabricated mouth and support structure for a container for dispensing stacked articles or packets.

It is another object of the present invention to provide a gravity-fed dispensing container which is formed from a single blank without gluing.

Typically, containers for stacked articles or packets are end-loaded from a flat tray or shoe. Particularly in the case of containers for small, flat packets, loading could be expedited if the stacks of articles did not have to be end-loaded from such trays or shoes.

Accordingly, it is an object of the present invention to provide a back-loading dispensing container for a vertical stack of small packets.

Handling costs are reduced if the shipping container for flat packets could function, without substantial modification, as the dispensing container and as a display for the articles.

Accordingly, it is an object of the present invention to provide a wall-hanging dispensing container for small packets with provision for displaying one of the packets.

These and other objects and features of the invention will become apparent from the claims and from the following description when read in conjunction with the accompanying drawings.

DETAILED DESCRIPTION

Figure 1:
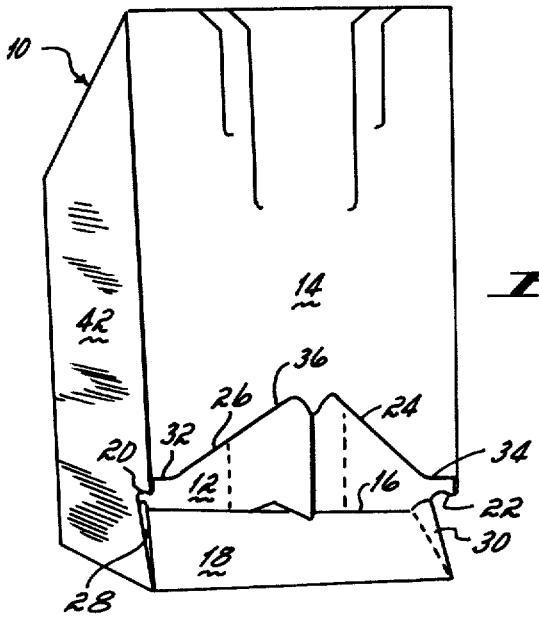
FIG. 1 is a pictorial front view of an assembled, unfilled container embodiment of the present invention.

Referring first to FIG. 1, a gravity-fed dispensing container 10 is illustrated. The container is hexahedral or six-sided in shape and adapted for vertical mounting, in the orientation shown in the figure, on a vertical structure such as a building wall. The container may be loaded with small articles (not shown) which may be dispensed through an opening in a lower portion of a front wall of the container. Advantageously, the container may be made from any type of foldable sheeting material, particularly paperboard. The construction of the container of FIG. 1 is discussed in connection with FIG. 2 which shows a paperboard blank from which the container of FIG. 1 may be formed, and FIGS. 2 and 3 which sequentially illustrate the assembly of the paperboard blank of FIG. 2 into the container of FIG. 1. Finally, the loading of the container with stacked articles and the dispensing of the articles from the container will be discussed in connection with FIG. 5.

The container 10 of FIG. 1 has a mouth opening 12 and article support structure 16 formed by infolding portions of the front wall 14 and adjoining side walls of the container. The support structure 16 provides underneath support for one or more stacks of articles located within the container. The support is provided forward of the center of gravity of the stack so that the articles are inclined downwardly and rearwardly toward the rear wall of the container.

The mouth opening 12 is bounded by a lower lip panel 18, portions 20 and 22 of the side walls of the container and an upper lip edge 24.

The lower lip panel 18 and the upper lip edge 24 are formed by cutting a lip cut line 26 in the front wall 14 of the container and infolding the lower lip panel 18 and gusset flaps 28 and 30 into the container. The lip cut line may include gate portions 32 and 34 which extend toward the center of the front wall 14 perpendicularly from the side edges of the front wall. The lip cut line extends beyond these perpendicular portions 32 and 34 into the side walls of the container. A central portion 36 of the lip cut line 26 may be formed in the shape of an inverted V. The gate portions 32 and 34 of the cut line inhibit the removal of more than one article at a time from each stack of articles in the container. The inverted V-shaped portion of the cut line provides greater clearance for finger access to the bottommost article in a stack of articles to facilitate removal.

Figure 2:
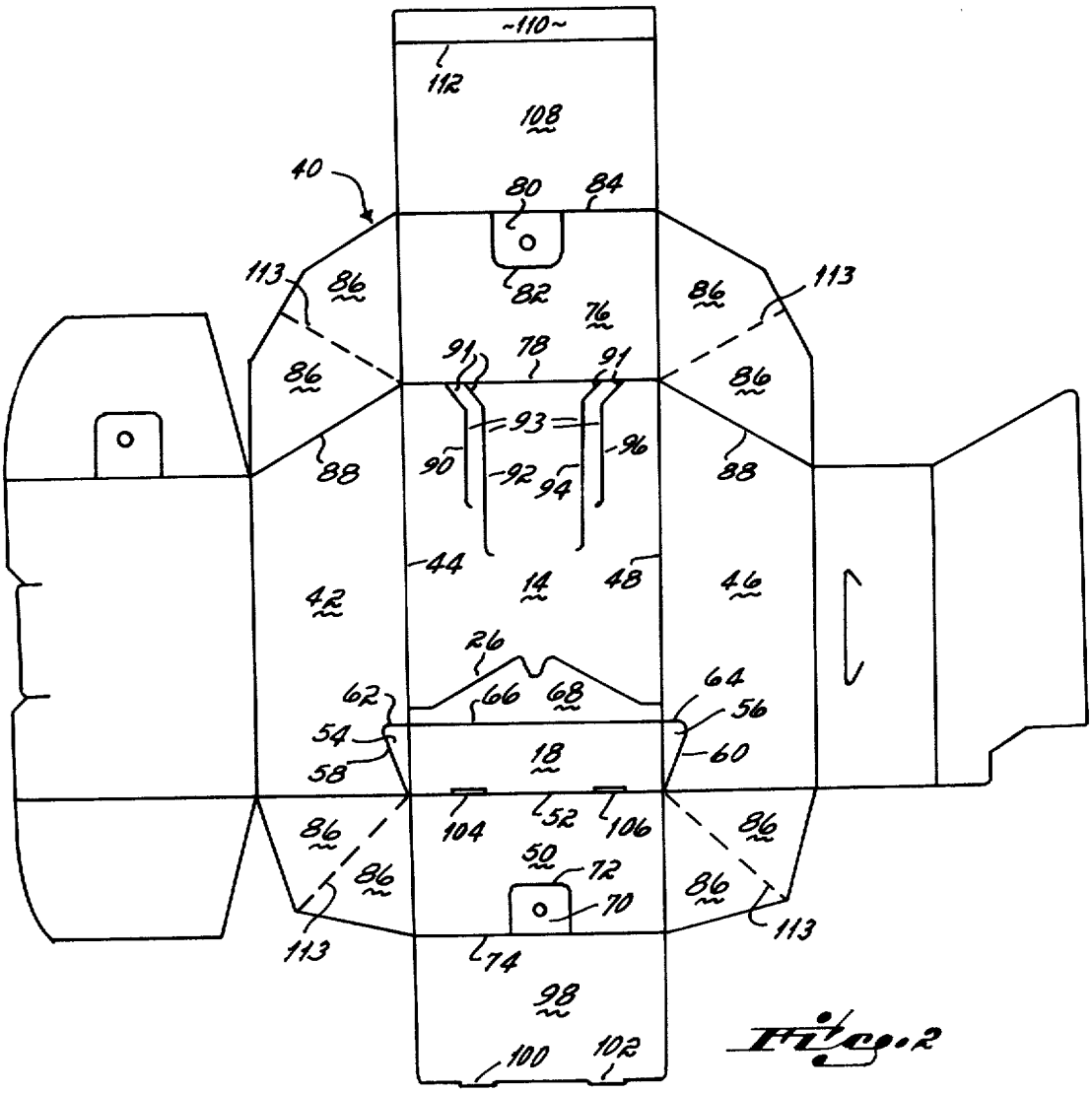
FIG. 2 is a plan view of a paperboard blank from which the container of FIG. 1 may be formed.

Referring now to FIG. 2, a blank 40 for making the container of FIG. 1 is illustrated. It will be noted that the blank 40 may be formed from a single continuous piece of sheeting material. The blank 40 includes the front wall panel 14 and a first side wall panel 42 connected to the front wall panel along a first fold line 44. A second side wall panel 46 is symmetrically located on the opposite side of the front wall panel 14 and connected to the front wall panel along a second fold line 48. A bottom wall panel 50 is connected to the front wall panel along a third fold line 52.

According to the teachings of the present invention, an infolding mouth and article support structure may be defined in the front wall 14 and side walls 42 and 46 of the container blank. The structure may include the lower lip panel 18. It will readily apparent that the lower lip panel is bounded by fold lines 44, 48 and 52 and by the lip cut line 26, which runs between fold lines 44 and 48. The infolding mouth and article support structure also includes a first lower lip gusset panel 54 and a second lower lip gusset panel 56, formed respectively in first and second side wall panels 42 and 46. The gusset panels are generally triangular in shape and bounded by first and second gusset panel fold lines 58 and 60. The gusset panel fold lines describe an acute angle with their respective adjacent fold lines 44 and 48. The fold lines are connected by extensions 62 and 64 of the lip cut line 26.

An article support fold line 66, perpendicular to fold lines 44 and 48, runs across the lower lip panel 18 to define, with the upper lip cut line 26 a free flap 68. In the assembled container the free flap 68 is inclined downwardly and rearwardly in the container and may partially support the bottommost article loaded in the formed container. Advantageously, the bottommost article is supported ahead of its center of gravity by the fold line 66, which, in turn, is maintained in position by the infolded gusset flaps 54 and 56.

To facilitate attachment of the container to a vertical surface, the container blank is formed with hanging tabs in several of the wall panels. The lower hanging tab 70 is defined in the bottom wall panel 50 by an open curve cut line 72 whose ends are joined by a fold line 74. A top wall panel 76, connected to the front wall panel 14 along a fourth fold line 78, also has a hanging tab 80 defined therein by an open curve cut line 82 joined by a fold line 84.

The side wall panels 42 and 46 are joined to the bottom wall panel 72 and the top wall panel 76 by gusset panels 86. It will be noted that upper edges 88 of the side wall panels 42 and 46 lie at a oblique angle with respect to the side edges of the front wall panel 14. As a result of this arrangement, in the assembled container, the top wall 76 lies at an oblique angle with respect to the front and rear walls of the container. In other words, the side walls 42 and 46 are trapezoidal. This feature is illustrated best in FIG. 1.

Display cut lines 90, 92, 94, and 96 are formed in the front wall panel 14. Each of the display cut lines has a first, upper portion 91 which begins at the cut line 78 and converges toward the center line of the front wall panel 14. Lower portions 93 of the cut lines are generally parallel to one another and are generally vertical with respect to the preferred orientation of the container (i.e., the orientation of the container where the edges of the side walls at fold lines 44 and 48 are vertical). The function of the display cut lines 90–96 will be discussed below in connection with FIGS. 6*a* and 6*b*.

Additional panels of the blank 40 facilitate assembly of the container and provide partitioning, a rear wall and structural strength for the container. A bottom wall flap 98 is connected to the bottom wall panel 50 along the fold line 74. The bottom wall flap is formed with tabs 100 and 102, for insertion in corresponding slots 104 and 106 formed along the cut line 52. A top wall flap 108 is connected along the fold line 84 to the top wall panel 76. A skirt panel 110 is connected to the top wall flap 108 along a fold line 112.

Figure 3:
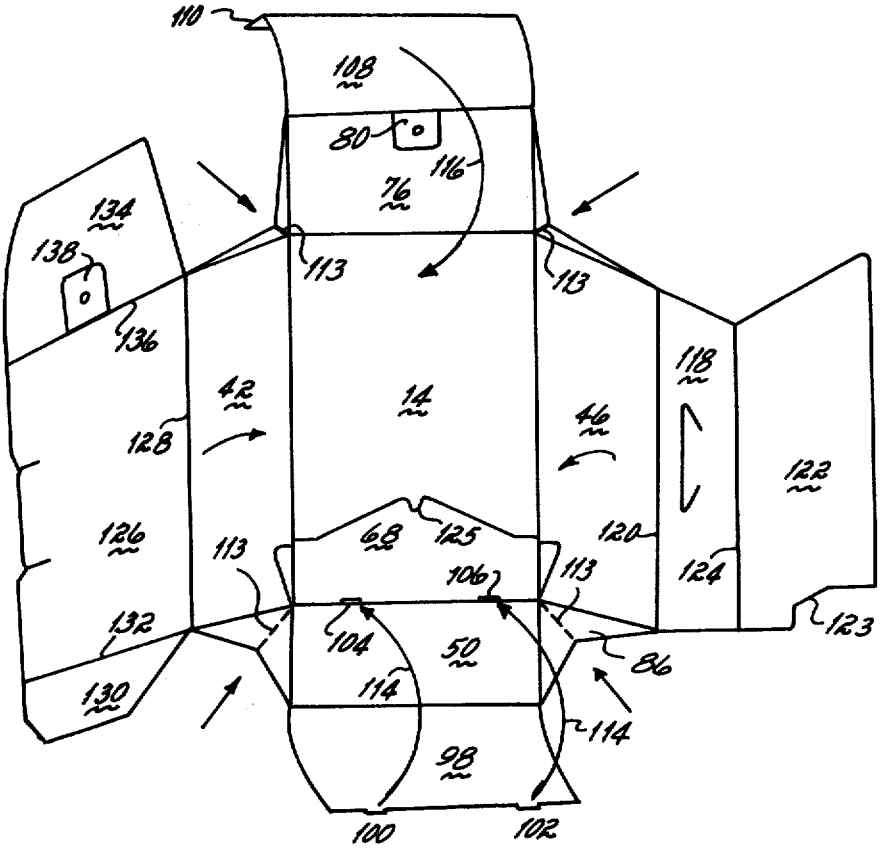
FIG. 3 is a pictorial back view of a container partially formed by folding of the blank of FIG. 2.

The function of the top and bottom wall flaps 98 and 108 is best shown in FIG. 3. FIG. 3 is a pictorial view of a partially assembled container made according to the present invention. As shown in the figure the gusset flaps 86 have been partially folded along broken cut lines 113. When the gusset flaps 86 have been folded flat, the side panels 42 and 46 and the bottom wall panel 50 will be perpendicular to the plane of the figure. The bottom wall of the container is assembled by folding the bottom wall flap 98, in the manner indicated by the arrows 114, over the folded lower gusset flaps and the bottom wall panel 50 so that the tabs 100 and 102 may be inserted in the slots 104 and 106.

The top wall is assembled by folding the top wall flap 108 over the folded upper gusset flaps and the top wall panel 76 in the manner indicated by the arrow 116. In so doing the skirt panel 110 is wedged flush against the front panel 14.

With continued reference to FIG. 3 additional panels associated with the rear wall of the container are described. An inner rear flap panel 118 is connected to the side wall panel 46 along a fold line 120. The inner rear flap panel is, in turn, connected to a vertical partition panel 122 along a fold line 124. In the completed container, the vertical partition panel 122 may divide the container vertically in half to provide two columns for stacking articles within the container. An edge 123 in the partition panel 122 is dimensioned and configured to engage a knotch 125 formed in the free flap 68 by the lip cut line.

On the other side of the blank illustrated in FIG. 3, an outer rear flap panel 126 is connected to the side wall panel 42 along a fold line 128. A bottom tuck flap 130 is connected to a lower edge of the outer rear flap panel 126 along a fold line 132. On the upper edge of the outer rear flap panel 126 is located a top tuck flap panel 134 connected to the panel 126 along a fold line 136. Advantageously, a hanging tab 138 may be formed in the top tuck flap panel 134 for use to reinforce the hanging tab 80 formed in the top wall panel 76.

Figure 4:
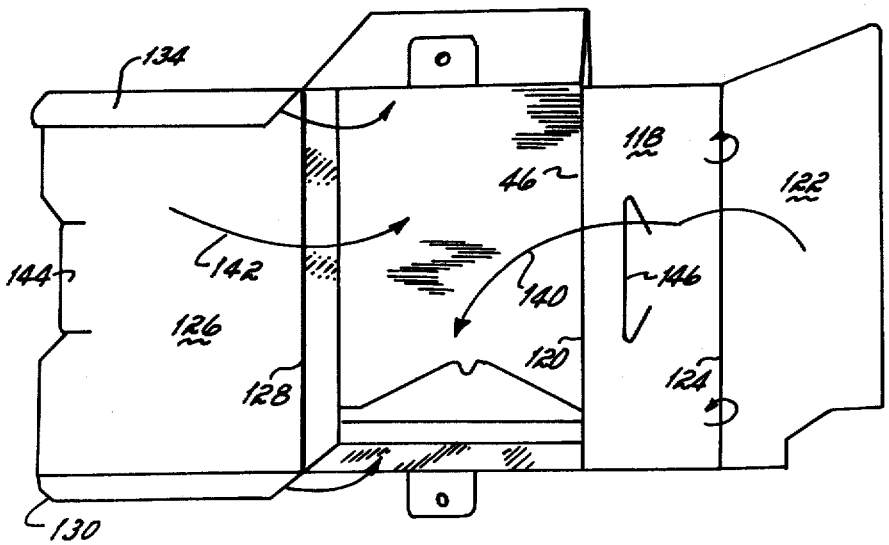
FIG. 4 is a pictorial back view of a container partially formed by folding of the blank of FIG. 2.

The final assembly of the container is best illustrated with reference to FIG. 4. In FIG. 4 the top and bottom walls of the container have been assembled to form an open-back box. At this time two parallel stacks of articles may be back loaded into the container. Then, the inner rear flap panel 118 and the vertical partition panel 122 may be folded along the fold lines 120 and 124 to locate the vertical partition panel between the stacks of articles and to orient the panel 118 as a partial back wall for the container. This folding action is indicated schematically by the arrow 140. Finally, the outer rear flap panel 126 may be folded along the fold line 128 to slip the tuck panels 130 and 134 into the interior of the container. This folding action is indicated schematically by the arrow 142. The outer rear flap panel may then be locked in place by inserting a tab 144 into a corresponding slot 146 in the inner rear flap panel.

Figure 5:
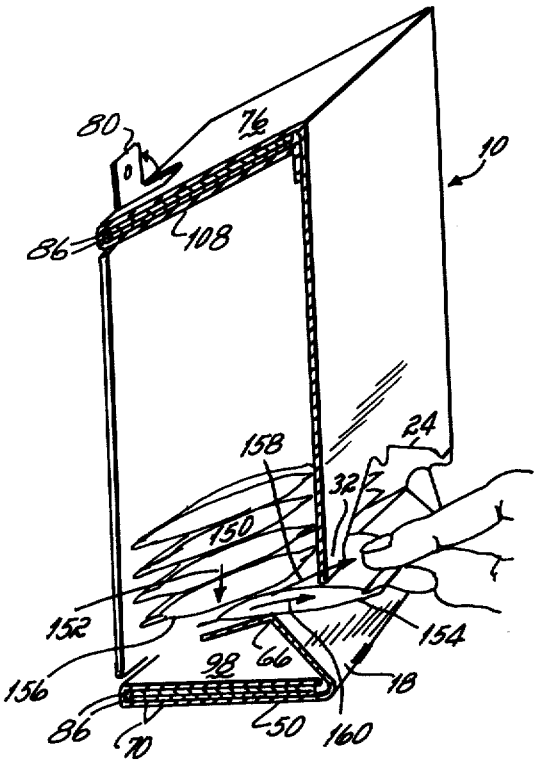
FIG. 5 is a pictorial view in partial cross-section showing the container of FIG. 1 and the removal of contents therefrom.

FIG. 5 is a pictorial view in partial cross section showing the container of FIG. 1 and a preferred method for removing articles from the container. In operation the filled container 10 can be attached to a vertical structure, such as a wall, by means of the hanging tabs 70 and 80. The provision of the hanging tabs at the top and bottom of the container facilitates the removal of articles from the container from the bottom of the container in that movement of the container is restricted and the container will not swing away from the wall if an outward force is exerted on an article within the container.

As illustrated in FIG. 5 a stack of articles 150 has been loaded into the container. It will be readily observed that while the stack itself is vertical, the individual articles are inclined with respect to horizontal. Advantageously, the angle of inclination of the top wall of the container with respect to horizontal is equal to the angle of inclination of the articles so that space within the container is used efficiently.

The arrow 152 schematically represents the center of gravity of the stack of articles. It will be readily apparent that the fold edge 66 of the lower lip panel 18 supports the stack 150 forward of the center of gravity 152 and this support orients the articles in the stack in the inclined manner.

When it is desired to remove an article from the container, access is had to the bottommost article through the mouth of the container. It will be observed that the upper lip edge 24 and the inwardly inclined lower lip panel 18 provide clearance for the fingers to enter the container and grasp the bottommost article 154 in the stack of articles. The article may be withdrawn by exterting an outward force on it until it clears the stack. The remaining articles in the stack will settle downward to provide a continuous gravity fed supply of articles.

Examination of FIG. 5 will also reveal the function of the gate edge 32. Specifically, the gate edge functions to permit removal of the articles one at a time. Normally, with the removal of the bottommost article 154 there would be a tendency for the second lowest packet 156 to be pulled out of the stack as well. However, movement of the second packet 156 is restricted by the gate edge 32. This gating function may be enhanced in the case that the articles are flexible, flat packets as illustrated. The vertical clearance of the gate edge 32 may be reduced so that the bottommost packet 154 cannot be removed along the straight line path (indicated schematically by the arrow 158). Instead, the packet must be removed by flexing it downward while exerting an outward force as indicated schematically by the arrow 160. In this way the packets may be removed in a simple outward motion which neatly removes the packets one by one.

Figure 6A:
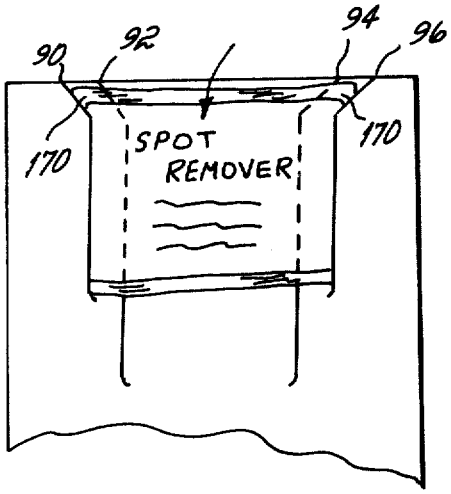
FIGS. 6*a* and 6*b* are plan views of the front face of the container of FIG. 1 showing alternative uses of display cuts in the front face.
Figure 6B:
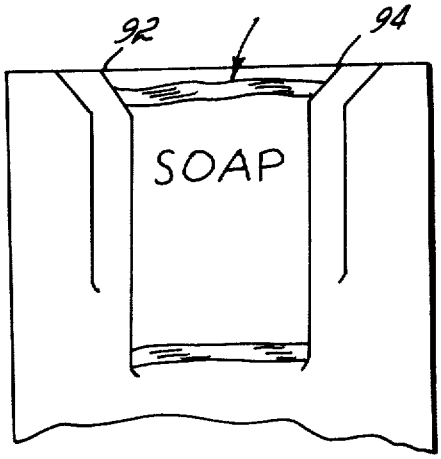

The use of the display cut lines is illustrated in FIGS. 6*a* and 6*b*. The container of the present invention may be used to contain roughly flat, rectangular shaped packets whose length is greater than their width. Normally such packets will have printing or other markings thereon to indicate the contents of the packets, instructions for use, etc. This information may be displayed by attaching the packet to the face of the front wall of the container. This may be accomplished by inserting the packet in slots formed by the display cut lines. In the case that the information on the packet is written along the length of the packet as illustrated in FIG. 6*a*, the packet is inserted in the most widely separated display cut lines 90 and 96. Advantageously, the display cut lines 90 and 96 are separated by a distance slightly less than the length of the packet so that the sealed edge 170 of the packet may be gripped between the edges of the paperboard along the cut lines 90 and 96.

Alternatively, where the information is written along the width of the packet as illustrated in FIG. 6*b* the packet may be inserted in the longer display cut lines 92 and 94 which are separated by a distance slightly less than the width of the packet. By providing both pairs of display cut lines equal respectively to the length and width of articles which may be carried by the container, the container may be used with packets having different orientations without modifying the container blank. The packets may, of course, be flexible and contain such items as tissues, shoe polish, spot remover or the like. Alternatively, they may be substantially rigid for items such as laboratory slides, tongue depressers, capsule containers or the like.

Figure 7:
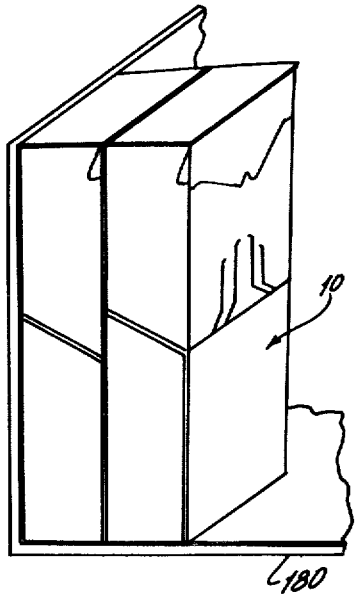
FIG. 7 is a pictorial view of several of the containers of FIG. 1 stacked in a rectangular carton.

FIG. 7 illustrates the manner in which a plurality of the containers of the present invention may be stacked in a shipping carton 180 to transport the containers in a minimum volume. It will be observed that the sloping top walls 76 of the containers may be located in face-to-face orientation to tightly pack the containers in the carton.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

I claim:

1. A hexahedral container for dispensing stacked packets through a mouth opening in a lower portion of a front wall of the container and for displaying one of said packets on the front wall, having means for attaching the container to a supporting structure so that a stack of packets is generally vertical;

a rear wall flap, normally closed by an interlocking tab, to provide access to the container to permit rear loading of packets into the container;

a mouth opening and support structure formed by infolding portions of the front and side walls of the container from a lip cut line on the front and side walls of the container, said structure providing underneath support for the stack of packets forward of the center of gravity of the stack so that the packets are inclined downwardly and rearwardly toward the rear wall flap of the container; and a pair of display cut lines in the front wall of the container for holding one of the packets on the front wall of the container for display;

whereby, the bottommost packet in the stack is removable by grasping through the mouth opening and pulling outwardly from the container, whereby a lower portion of the front wall bounded by the lip cut line resists removal of additional packets in the stack as the bottommost packet is removed, and whereby the attaching means prevents movement of the container away from the supporting structure as the bottommost packet is removed.

2. In a container having front and rear walls interconnected by side walls and adapted for holding packets in a generally vertical stack and for dispensing packets from the bottom of the stack through a mouth opening in a lower portion of the front wall of the container, a support structure for the stack of packets comprising, a lower lip panel having a front edge terminating a substantial distance rearward of said front wall and forward of the center of said container and being inclined rearwardly and downwardly, said lower lip panel being located at the lower end of said container adjacent said mouth opening, said lower lip panel providing underneath support for the vertical stack of packets formed of the center of gravity of said packets, and a gate edge on the upper portion of said mouth opening for obstructing removal of more than one packet from the stack at one time, whereby the lowermost packet may be bent slightly downwardly and pulled through said mouth opening, said lower lip panel and the support for said lower lip panel comprising:

a narrow panel formed from the lower end portion of said front wall, triangular gussets formed from said side walls and hinged respectively to said narrow panel and said side wall, said lip panel being hinged to said narrow panel, said narrow panel extending into said container and supported there by said gussets, said lip panel being cut from said front wall and extending rearwardly and inclined downwardly from said narrow panel.

3. A container as in claim 2 in which said gate edge is formed by the lower edge of said front wall which remains after said lip panel is cut from said front wall.

* * * * *